US005982084A

United States Patent [19]

Etou

[11] Patent Number: 5,982,084

[45] Date of Patent: Nov. 9, 1999

[54] COLOR CATHODE RAY TUBE

[75] Inventor: Hideaki Etou, Osaka, Japan

[73] Assignee: Matsushita Electronics Corporation, Osaka, Japan

[21] Appl. No.: 09/050,759

[22] Filed: Mar. 30, 1998

[30] Foreign Application Priority Data

May 29, 1997 [JP] Japan ..... 9-140259

[51] Int. Cl.[6] ..... H01J 29/82; H01J 29/07

[52] U.S. Cl. ..... 313/406; 313/404; 313/407

[58] Field of Search ..... 313/402, 404, 313/405, 406, 407, 408

[56] References Cited

U.S. PATENT DOCUMENTS

| | | | |
|---|---|---|---|
| 3,343,024 | 9/1967 | Torrence | 313/406 |
| 3,492,522 | 1/1970 | Pappadis | 313/406 |
| 3,671,794 | 6/1972 | Nakamura et al. | 313/406 |
| 4,012,661 | 3/1977 | Danielson, Jr. et al. | 313/405 |
| 4,367,430 | 1/1983 | Matsushita et al. | 313/405 |

FOREIGN PATENT DOCUMENTS

| | | | |
|---|---|---|---|
| 60-232639 | 11/1985 | Japan | H01J 29/02 |
| 3-17937 | 1/1991 | Japan | H01J 29/02 |
| 6-9042 | 2/1994 | Japan | H01J 29/02 |
| 9-199044 | 7/1997 | Japan | H01J 29/02 |

*Primary Examiner*—Michael Day
*Attorney, Agent, or Firm*—Merchant & Gould P.C.

[57] ABSTRACT

A color cathode ray tube is provided which comprises a face panel having an inner surface on which phosphors are formed, a funnel connected to the rear portion of the face panel, an electron gun housed in the neck portion of the funnel, a frame attached to pins on the inside of the face panel through springs provided on two short sides of the frame and one long side thereof, and a shadow mask attached to the frame at a predetermined distance from the phosphor surface. The operation length of the spring on the short side is longer than that of the spring on the long side, so that the amount of upward displacement of landing points during the entire doming phenomenon is decreased. Thus, the deterioration in the uniformity of the luminance of white quality is reduced in the color cathode ray tube.

13 Claims, 7 Drawing Sheets

COLOR CATHODE RAY TUBE

FIELD OF THE INVENTION

The present invention relates to a color cathode ray tube for a television and a computer display, and more particularly to a spring that holds the mask frame of the color cathode ray tube within the face panel thereof.

BACKGROUND OF THE INVENTION

As a method for holding a frame for a shadow mask within a face panel in a color cathode ray tube, a three-pin method has conventionally been used in which the frame is held through three springs located on the two short sides and one long side respectively. In this method, a pin is located in the center on the long side and two pins are located on the short sides at a predetermined distance from the center toward the long side that does not have a pin (see Publication of Japanese Patent Application (Tokkai Sho) No. 60-232639).

A conventional color cathode ray tube will be described below in which a frame for a shadow mask is held within a face panel using the three-pin method. FIG. 7 shows a sectional front view of a color cathode ray tube in the prior art. As shown in FIG. 7, a shadow mask 52 attached to a frame 51 is located on the inside of a face panel 50. The frame 51 for the shadow mask is held by the face panel 50 through a spring 56 supported by a pin 55 provided on the inner surface of the face panel 50. One end of the spring 56 is fixed to the frame 51 at two welding points 53 and 54, and the other end is supported by the pin 55. The distance (operation length) 57 from the pin 55 to the welding point 53 of the spring 56 that is closer to the pin 55 is set at the same value among the three springs 56*a*, 56*b* and 56*c*.

Due to the increase of electric current associated with the high luminance of recent color cathode ray tubes, a phenomenon is caused in which the entire shadow mask thermally expands to form a dome shape in the direction of the phosphor surface (hereinafter such a phenomenon is referred to as "the entire doming"). In order to solve the entire doming problem, an invar material having a lower coefficient of thermal expansion than iron has been used as the material of the shadow mask.

Also, in order to obtain higher definition images in computer display monitors, the phosphor surface of the face panel is formed in dot shape and precisely positioned so that electron beams passed through the dot-shaped holes of the shadow mask accurately strike phosphor dots on the phosphor surface.

However, the conventional structure as described above cannot fully meet the requirements for recent display monitors. Since the reverse mode in which a white background is displayed on the screen is common as a use state of a recent display monitor, and a high luminance of 30 Ft-L as the brightness of displayed images and full scan as the display size is common, the amount of electric current increases. Thus, the entire doming phenomenon caused by the thermal expansion of the shadow mask and the misalignment of the dots of the shadow mask and the phosphor dots on the phosphor surface cannot be fully prevented. Therefore, due to the misalignment of the position where electron beams strike and the phosphor dots, the efficiency of emitting light decreases, thus deteriorating the white quality of the screen, for example, causing a decrease in luminance output and a change in chromaticity.

SUMMARY OF THE INVENTION

In order to solve the above problems in the prior art, it is an object of the present invention to provide a color cathode ray tube to reduce the displacement amount of the landing points of electron beams toward the long side of a shadow mask frame that has a spring (this direction is hereinafter referred to as "upward") during the entire doming and control the deterioration in white quality.

In order to accomplish the above object, the present invention provides a color cathode ray tube comprising a face panel having an inner surface on which phosphors are formed, a funnel connected to the rear portion of the face panel, an electron gun housed in the neck portion of the funnel, a frame attached to pins on the inside of the face panel through springs provided on two short sides of the frame and one long side thereof, and a shadow mask attached to the frame at a predetermined distance from the phosphor surface, wherein an operation length of the spring on the short side is longer than an operation length of the spring on the long side. There is a difference in thermal expansion property between the spring and the frame. According to the structure of the color cathode ray tube, by increasing the operation length of the spring on the short side to increase the amount of thermal expansion of the spring on the short side, the difference between the amount of thermal expansion of the frame and the amount of thermal expansion of the spring on the short side and the face panel is reduced, so that the amount of upward displacement of the shadow mask due to thermal expansion can be decreased. In other words, the difference in the amount of thermal expansion between the spring and the frame during the entire doming can be reduced to reduce the upward displacement of landing points. As a result, the misalignment of the electron beams and the screen phosphors, which is called mislanding, can be prevented. Therefore, the deterioration in the white quality of the screen, such as a decrease in luminance output, and a change in chromaticity can be reduced.

In the structure of the color cathode ray tube of the present invention, it is preferable that the operation length of the spring on the short side is 25 to 50% longer than the operation length of the spring on the long side. According to the preferable example, the upward displacement of the shadow mask can be restricted by increasing the amount of the thermal expansion of the spring on the short side.

It is preferable that the pin supporting the spring on the short side is located closer to a long side that does not have a spring than is the center on the short side of the face panel. Also, it is preferable that the pin supporting the spring on the long side is located in the center of a long side of the face panel. According to the preferable example, the upward displacement of the shadow mask can be prevented by decreasing the difference in the amount of thermal expansion between the frame and the spring on the short side of the face panel.

It is preferable that the coefficient of thermal expansion of the spring on the short side is greater than the coefficient of thermal expansion of the frame. According to the preferable example, the amount of upward displacement of the shadow mask due to thermal expansion can be reduced by making the operation length of the spring on the short side longer than that of the spring on the long side and by reducing the difference between the amount of thermal expansion of the frame and the total amount of thermal expansion of the spring on the short side and the face panel.

It is preferable that the color cathode ray tube of the present invention is used for a computer display monitor. In the computer display monitor, the phosphor surface of the face panel is formed in a dot shape. The dots of the shadow mask and the phosphor dots on the phosphor surface should be precisely aligned. In the color cathode ray tube of the present invention, the misalignment of the electron beams passed through the dots of the shadow mask and the phosphor dots can be prevented. If the color cathode ray tube of the present invention is used for a computer display monitor, the deterioration in the white quality of the screen, such as a decrease in luminance output and a change in chromaticity, can be suppressed. Therefore, a greater effect of the present invention can be obtained, and the value of the monitor as a commercial product can be significantly increased.

Furthermore, the present invention can be similarly applied to a color cathode ray tube having a square frame.

The present invention also provides a color cathode ray tube comprising a face panel having an inner surface on which phosphors are formed, a funnel connected to a rear portion of the face panel, an electron gun housed in a neck portion of the funnel, a four-sided frame attached to pins on the inside of the face panel through springs provided on three of the four sides of the frame, and a shadow mask attached to the frame at a predetermined distance from the inner surface of the face panel, wherein an operation length of the two springs provided on opposed sides of the frame is longer than an operation length of the other spring.

In the above structure, it is preferable that the operation length of the two springs provided on the opposed sides is 25 to 50% longer than the operation length of the other spring.

In the above structure, it is preferable that the pins supporting the two springs provided on the opposed sides are located closer to a side that does not have a spring than is the center of sides of the face panel on which the pins are provided.

In the above structure, it is preferable that the pin supporting the other spring is located in the center of a side of the face panel on which the pin is provided.

In the above structure, it is preferable that the coefficient of thermal expansion of the two springs provided on the opposed sides is greater than the coefficient of thermal expansion of the frame.

In the above structure, it is preferable that the color cathode ray tube is a display monitor for a computer.

DETAILED DESCRIPTION OF THE INVENTION

The present invention will be described below in more detail by way of an embodiment.

Figure 1:
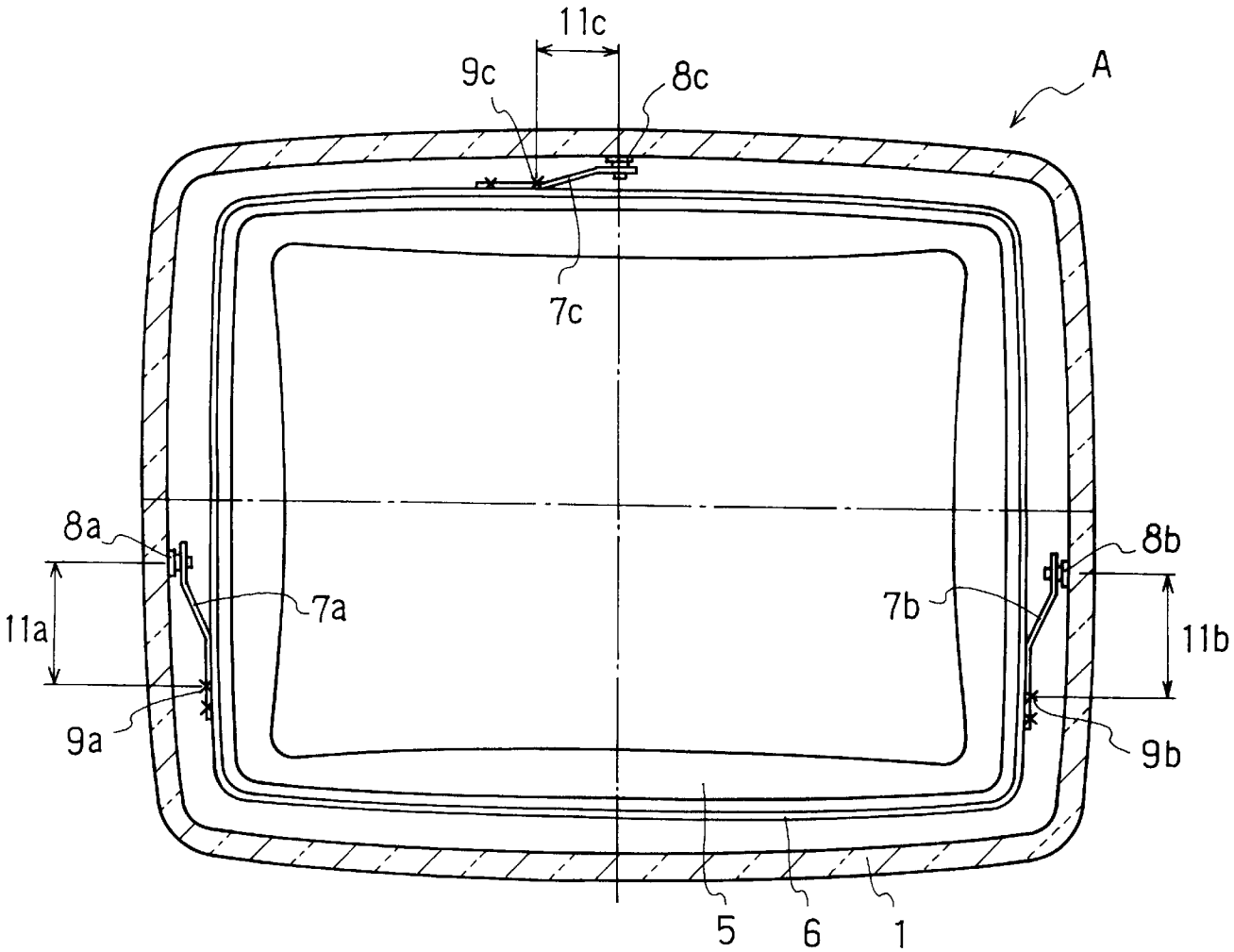
FIG. 1 is a sectional front view of one embodiment of a color cathode ray tube according to the present invention.
Figure 2:
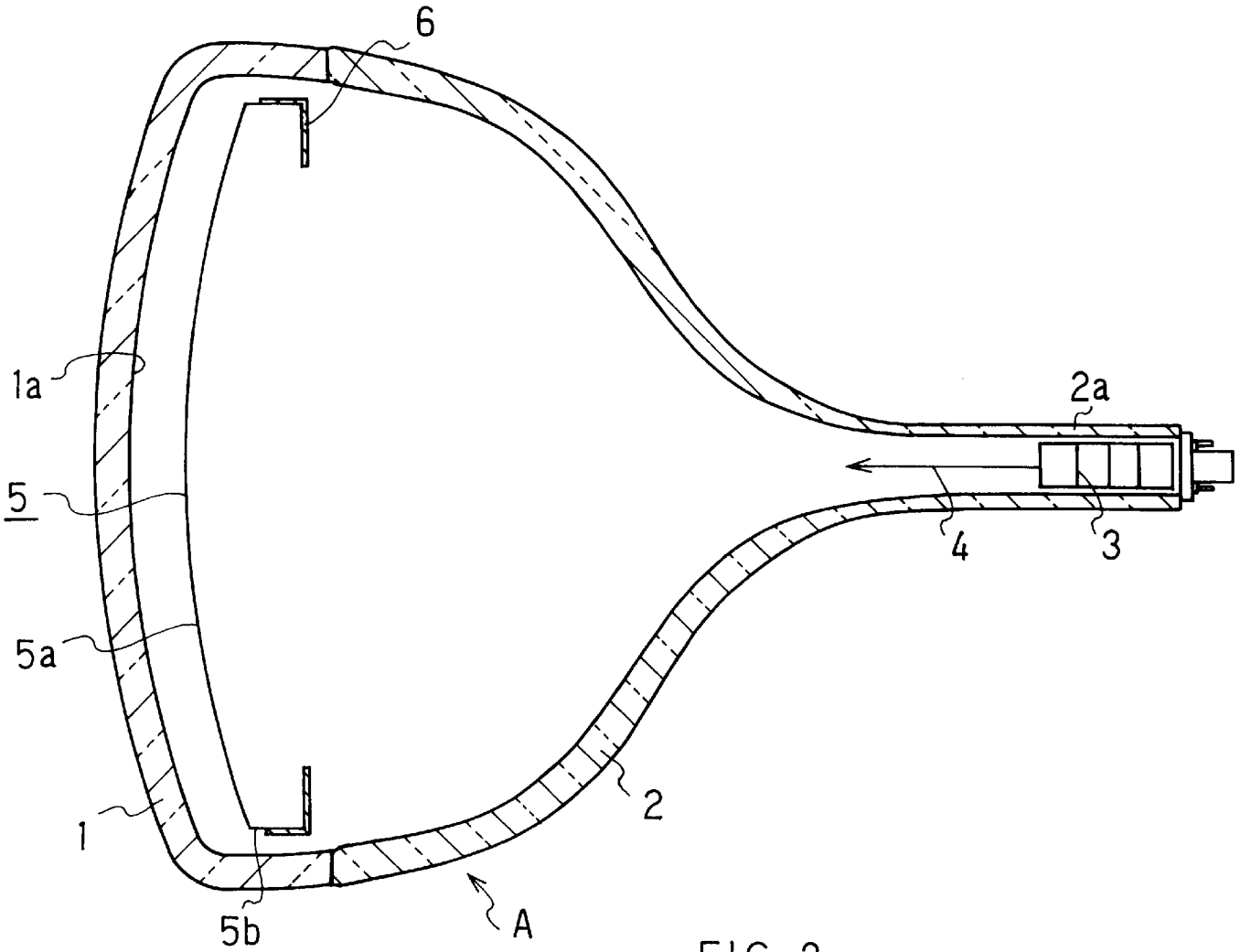
FIG. 2 is a sectional side view of one embodiment of the color cathode ray tube according to the present invention.

FIG. 1 is a sectional front view of one embodiment of the color cathode ray tube according to the present invention, and FIG. 2 is a sectional side view of this embodiment. As shown in FIGS. 1 and 2, a color cathode ray tube A comprises a glass face panel 1, a glass funnel 2 connected to the rear portion of the face panel 1, an electron gun 3 for emitting electron beams 4 housed in the neck portion 2*a* of the funnel 2. The inner surface of the face panel 1 is coated with three colors of phosphor dots, thus forming a phosphor surface 1*a*. A shadow mask 5 is located near the inner surface of the face panel 1 (the phosphor surface 1*a*) and parallel to the phosphor surface 1*a*. The shadow mask 5 has a large number of transparent holes arranged regularly and selects colors for three electron beams 4 emitted from the electron gun 3.

As shown in FIGS. 1, 2, 3 and 4, the shadow mask 5 comprises a shadow mask main body 5*a* of a substantially spherical surface shape located parallel to the phosphor surface 1*a,* and a skirt portion 5*b* formed by folding the peripheral portion of the shadow mask main body 5*a*. A frame 6 is located on the inside of the face panel 1, and the skirt portion 5*b* of the shadow mask 5 is fitted to the inside of the frame 6. The shadow mask 5 is fixed to the frame 6 by spot welding in the middle portion on the long sides, the middle portion on the short sides, and corner portions, thus forming a "frame combination".

Figure 3:
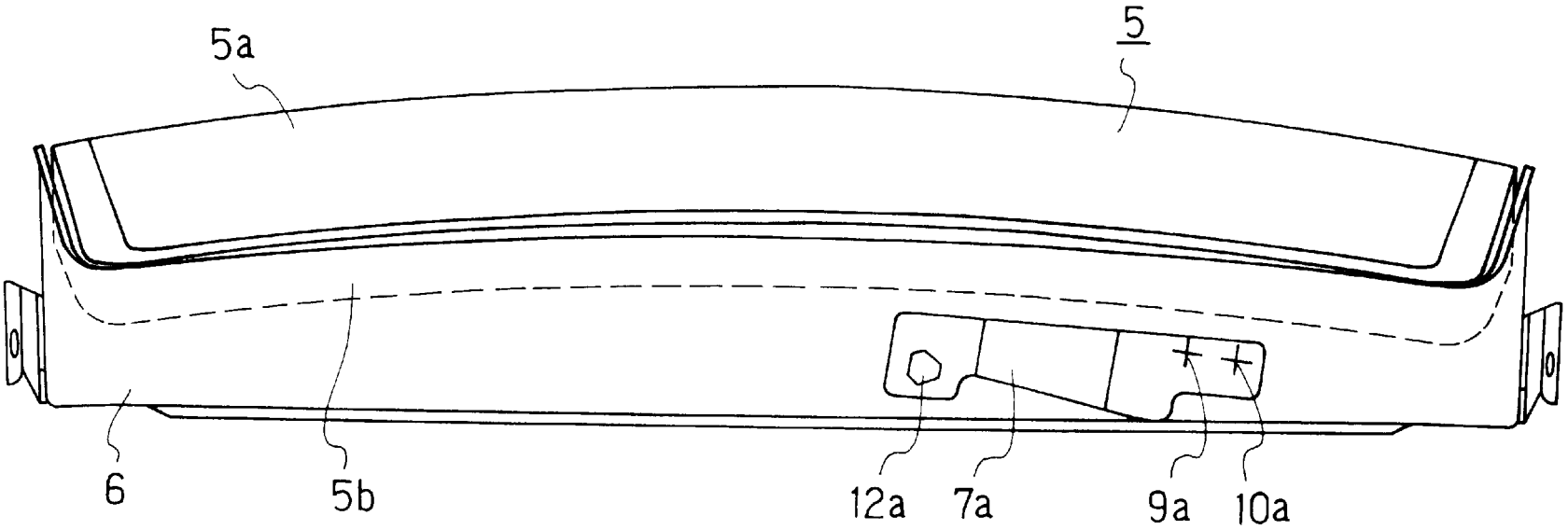
FIG. 3 is a side view of a structure of a shadow mask on the short side in one embodiment of the color cathode ray tube according to the present invention.
Figure 4:
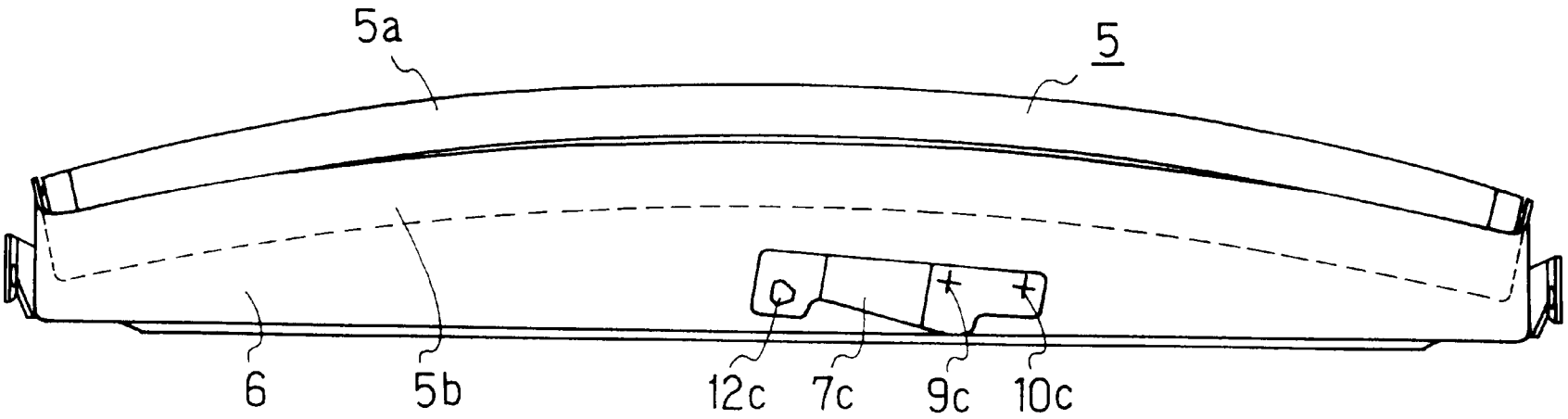
FIG. 4 is a side view of a structure of the shadow mask on the long side in one embodiment of the color cathode ray tube according to the present invention.

As shown in FIGS. 1, 3 and 4, this frame combination (the combination of the shadow mask 5 and the frame 6) is held by the face panel 1 through springs 7. One end of the spring 7 is welded to the frame 6 at two welding points 9 and 10, and the other end is supported by a pin 8 provided on the inner surface of the face panel 1. Also, the spring 7 is supported by the pin 8 by fitting the pin 8 into a hole 12, formed at the other end of the spring 7, in the position where the diameter of the pin 8 is 5.61 mm. The space between the face panel 1 and the frame 6 is 9 mm, and the amount of the protrusion of the pin 8 is 5 mm. The distance from the pin 8 to the welding point 9, which is the closer to the pin 8 of the welding points of the spring 7, is hereinafter referred to as an "operation length 11".

Three pins 8 on the inner surface of the face panel 1 that supports the frame combination (the combination of the shadow mask 5 and the frame 6) are provided on the two short sides and the upper long side respectively (8*a,* 8*b* and 8*c*). When the frame combination is thus supported at the three points, the position of the pins 8*a* and 8*b* on the short sides is shifted downward from the central horizontal axis. For example, the amount of the shift is 29.13 mm in a 48 cm color cathode ray tube. The length of the long and short sides of the face panel 1 is 440.5 mm and 341.8 mm respectively. The length of the long and short sides of the shadow mask 5 is 400.0 mm and 302.0 mm respectively.

In this embodiment, a spring 7 of a stainless steel having a high coefficient of thermal expansion whose thickness is about 1.0 mm and whose width is about 12 mm is used in manufacturing a 48 cm-90° color cathode ray tube. The entire length of each of two springs 7*a* and 7*b* on the short sides is 81 mm, and each of the operation lengths 11*a* and 11*b* is 60.0 mm. The entire length of the spring 7*c* on the long side is 75 mm and the operation length 11*c* is 44.2 mm.

In such a color cathode ray tube comprising the shadow mask 5, the three electron beams 4 emitted from the electron gun 3 are electromagnetically deflected and passed through a large number of transparent holes on the shadow mask main body 5*a* that selects colors. Since the shadow mask main body 5*a* is made of an invar material, that is a metal having a low coefficient of thermal expansion (coefficient of thermal expansion: $10\times10^{-7}$), and the transmission rate of the electron beams 4 is usually 15 to 25%, most of the electron beams 4 strikes the portion except for the transparent holes of the shadow mask main body 5*a*. Thus, the shadow mask 5 is heated during the operation of the color cathode ray tube.

During the operation of the color cathode ray tube, the heat of the shadow mask 5 is conducted to the face panel 1 (coefficient of thermal expansion: $99\times10^{-7}$) through the frame 6 of a low carbon steel (coefficient of thermal expansion: $117\times10^{-7}$) and the spring 7 of a stainless steel that has a high coefficient of thermal expansion (coefficient of thermal expansion: $171\times10^{-7}$), each of which causes thermal expansion.

Figure 5:
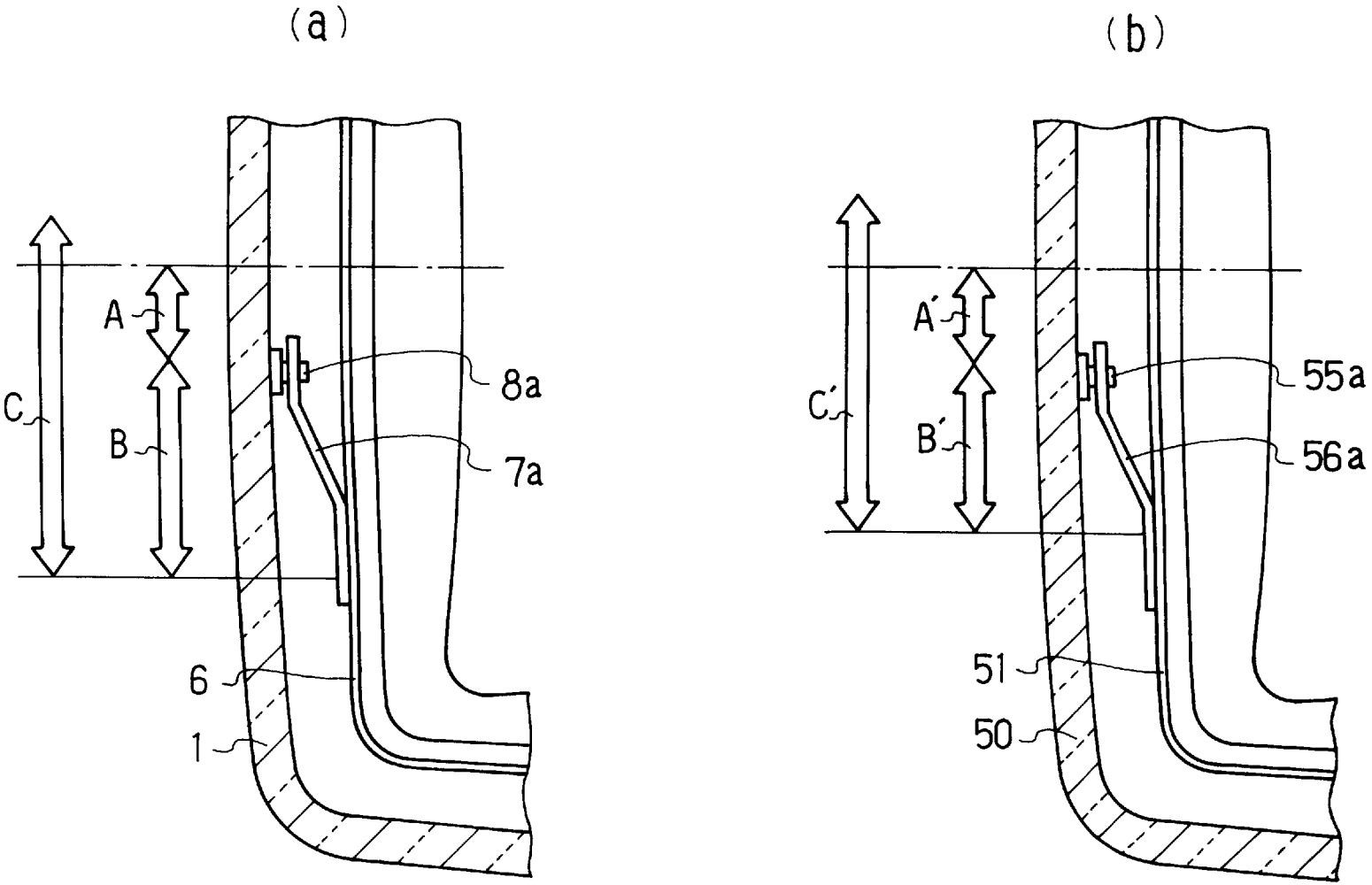
PRIOR ART FIG. 5
FIG. 5 is a partially sectional front view for explaining the thermal expansion of the shadow mask.
Figure 6:
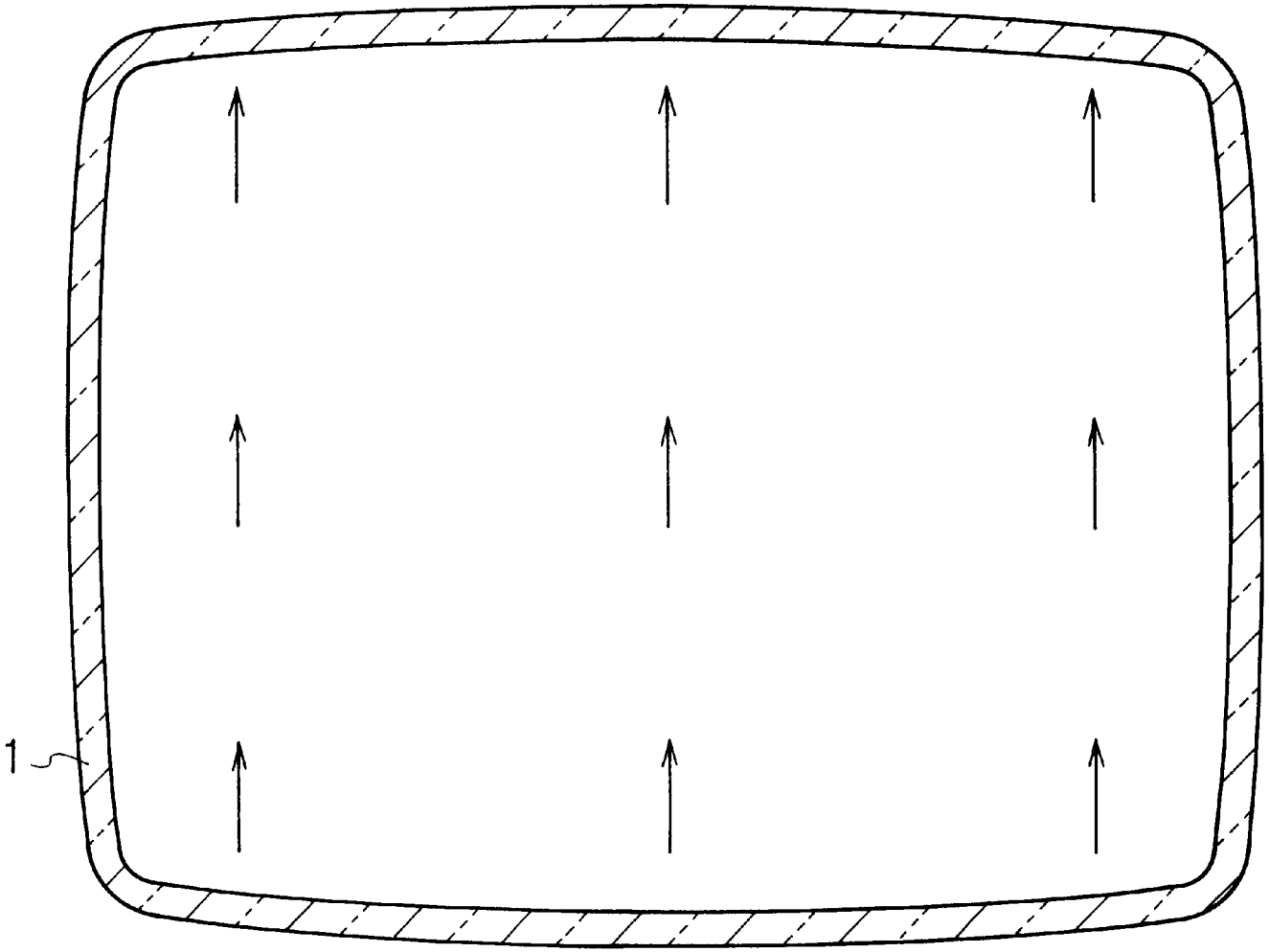
FIG. 6 is a schematic front view showing the direction in which landing points are displaced on the face panel during the entire doming in the color cathode ray tube of the present invention.
Figure 7:
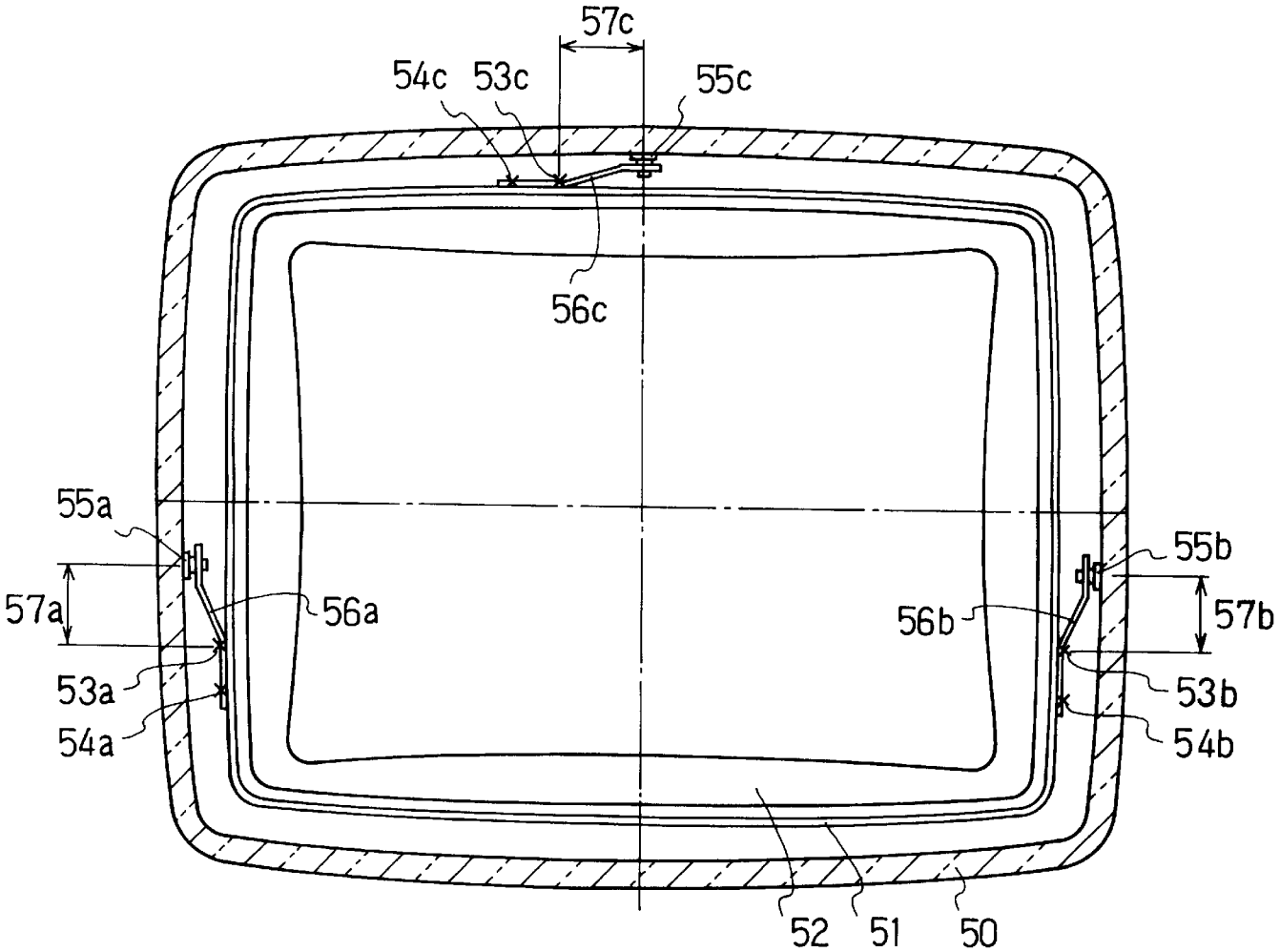
FIG. 7 PRIOR ART
FIG. 7 is a sectional front view of a color cathode ray tube according to the prior art.

As shown in FIG. 5 (*a*), C is the amount of thermal expansion of the frame 6 on the short side along the distance from the central horizontal axis of the frame 6 to the position where the spring is welded, A is the amount of thermal expansion of the face panel 1 on the short side along the distance from the central horizontal axis of the face panel 1 to the pin 8*a,* and B is the amount of thermal expansion of the spring 7*a* along the operation length 11*a*. In considering the thermal expansion in the direction of the length of the spring 7*a,* there is a difference in thermal expansion property between the spring 7*a* and the frame 6. By increasing the operation length of the spring 7*a* to increase the amount of thermal expansion B of the spring 7*a,* the difference between the amount of thermal expansion C of the frame 6 and the total amount of thermal expansion (A+B) of the spring 7*a* and the face panel 1 is reduced, so that the amount of upward displacement of the shadow mask due to the thermal expansion can be decreased.

In this case, it is desirable that the operation length of the springs 7*a* and 7*b* on the short sides is 25 to 50% longer than the operation length of the spring 7*c* on the long side. If the operation length of the springs 7*a* and 7*b* is longer by less than 25% than that of the spring 7*c,* the action and effect of the present invention, that is, reducing the difference between the amount of thermal expansion C of the frame 6 and the total amount of thermal expansion (A+B) of the spring 7*a* and the face panel 1, cannot be fully achieved. If the operation length of the springs 7*a* and 7*b* is longer by more than 50% than that of the spring 7*c,* the springs 7*a* and 7*b* on the short side become too long, resulting in restrictions on mechanism, for example, the position for attaching the springs 7*a* and 7*b* to the frame 6 cannot be ensured. If the operation length of the springs 7*a* and 7*b* is 35 to 40% longer than that of the spring 7*c*, the effect further improves. If the operation length of the springs 7*a* and 7*b* is longer by more than 35% than that of the spring 7*c*, a practically appropriate effect of correction can be obtained. If the operation length of the springs 7*a* and 7*b* is longer by less than 40% than that of the spring 7*c*, springs of the same material and thickness as the conventional spring can be used in view of the strength of the springs, which is practically preferable.

In a corresponding conventional color cathode ray tube, the entire length of every spring is 75 mm, the operation length of the spring is 44.2 mm, and other portions are the same as those of this embodiment. As shown in FIG. 5 (*b*), the sum of the amount of thermal expansion A' of a face panel 50 on the short side along the distance from the central horizontal axis of the face panel 50 to a pin 55*a* and the amount of thermal expansion B' of a spring 56*a* along the operation length is smaller than the amount of thermal expansion C' of a frame 51 on the short side along the distance from the central horizontal axis of the frame 51 to the position where the spring is welded, so that the upward displacement of the shadow mask occurs.

Next, effects in this embodiment will be described.

The structure of this embodiment was applied to a 48 cm (20 inch)-90° color cathode ray tube and operated under the conditions of anode voltage Va=25 kV, anode current Ia=800 $\mu$A, 100% scan, and white signals. After two hours, at which time the entire doming effect became stable, the amount of change in the misalignment of phosphors and electron beams was measured as the amount of displacement of landing points by means of LND-060-1P manufactured by LINK SEED SYSTEM INC. at nine points, that is, one point in the center of the face panel, two points on the horizontal axis 180 mm away from the center to the left and right sides, two points on the vertical axis 130 mm away from the center to the upper and lower sides, and four points in corner portions on the diagonal axes 220 mm away from the center. As a result, the upward displacement of landing points occurred uniformly at all the points. The displacement amount was substantially the same among all the points, about 2 $\mu$m.

On the other hand, the amount of upward displacement of landing points was 5 $\mu$m in the conventional color cathode ray tube (the operation length on the short side is 44.2 mm, that is, the same length as the operation length on the long side) under the same measurement conditions.

Thus, the amount of upward displacement of landing points was reduced in this embodiment, so that the deterioration in the uniformity of the luminance of white quality was 1.5%, that is, the deterioration was improved by 4% with respect to the 5.5% observed in the conventional color cathode ray tube.

As described above, according to the present invention, an asymmetrical upward displacement during the entire doming phenomenon can be reduced by 60%, from 5 $\mu$m in the conventional color cathode ray tube to 2 $\mu$m, so that the deterioration in the uniformity of the luminance of white quality caused by the entire doming phenomenon is 1.5%. That is, the deterioration can be improved by 4% with respect to the 5.5% observed in the conventional color cathode ray tube.

While the frame is rectangular in the above description, the shape is not limited to rectangular in the present invention. A color cathode ray tube having a square frame can be similarly used, and similar effects can be obtained. In the rectangular frame, there is no specific length ratio of the long side to the short side. A frame having a substantially square shape, or a frame having a side length ratio of 4:3, 16:9, etc. can be similarly used.

The invention may be embodied in other forms without departing from the spirit or essential characteristics thereof The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A color cathode ray tube comprising:

a face panel having an inner surface on which phosphors are formed;

a funnel connected to a rear portion of the face panel;

an electron gun housed in a neck portion of the funnel;

a frame attached to pins on the inside of the face panel through springs provided on two short sides of the frame and one long side of the frame; and a shadow mask attached to the frame at a predetermined distance from the inner surface of the face panel, wherein an operation length of the springs on the short sides is longer than an operation length of the spring on the long side.

2. The color cathode ray tube as defined in claim 1, wherein the operation length of the spring on the short side is 25 to 50% longer than the operation length of the spring on the long side.

3. The color cathode ray tube as defined in claim 1, wherein the pin supporting the spring on the short side is located closer to a long side that does not have a spring than is the center on the short side of the face panel.

4. The color cathode ray tube as defined in claim 1, wherein the pin supporting the spring on the long side is located in the center of a long side of the face panel.

5. The color cathode ray tube as defined in claim 1, wherein a coefficient of thermal expansion of the spring on the short side is greater than a coefficient of thermal expansion of the frame.

6. The color cathode ray tube as defined in claim 1, wherein the color cathode ray tube is a display monitor for a computer.

7. A color cathode ray tube comprising:

a face panel having an inner surface on which phosphors are formed;

a funnel connected to a rear portion of the face panel;

an electron gun housed in a neck portion of the funnel;

a four-sided frame attached to pins on the inside of the face panel through springs provided on three of the four sides of the frame; and a shadow mask attached to the frame at a predetermined distance from the inner surface of the face panel, wherein an operation length of two springs provided on opposed sides of the frame is longer than an operation length of the other spring.

8. The color cathode ray tube as defined in claim 7, wherein the operation length of the two springs provided on the opposed sides is 25 to 50% longer than the operation length of the other spring.

9. The color cathode ray tube as defined in claim 7, wherein the pins supporting the two springs provided on the opposed sides are located closer to a side that does not have a spring than is the center of sides of the face panel on which the pins are provided.

10. The color cathode ray tube as defined in claim 7, wherein the pin supporting the other spring is located in the center of a side of the face panel on which the pin is provided.

11. The color cathode ray tube as defined in claim 7, wherein a coefficient of thermal expansion of the two springs provided on the opposed sides is greater than a coefficient of thermal expansion of the frame.

12. The color cathode ray tube as defined in claim 7, wherein the frame is square.

13. The color cathode ray tube as defined in claim 7, wherein the color cathode ray tube is a display monitor for a computer.

* * * * *